United States Patent [19]

Sakamoto

[11] Patent Number: 4,720,277

[45] Date of Patent: Jan. 19, 1988

[54] RECEPTACLE

[75] Inventor: Haruo Sakamoto, Tokyo, Japan

[73] Assignee: E. I. Du Pont de Nemours and Company, Wilmington, Del.

[21] Appl. No.: 930,477

[22] Filed: Nov. 14, 1986

[30] Foreign Application Priority Data

Nov. 30, 1985 [JP] Japan ..... 60-185446[U]

[51] Int. Cl.[4] ..... H01R 13/11

[52] U.S. Cl. ..... 439/842

[58] Field of Search ..... 339/256 R, 258 R, 258 P

[56] References Cited

U.S. PATENT DOCUMENTS

| | | | |
|---|---|---|---|
| 3,047,832 | 7/1962 | Deakin | 339/256 R |
| 3,362,008 | 1/1968 | Berg | 339/258 |
| 3,370,265 | 2/1968 | Berg | 339/256 |
| 3,425,030 | 1/1969 | Hadden | 339/256 |
| 3,538,491 | 11/1970 | Longenecker et al. | 339/256 R |
| 3,663,931 | 5/1972 | Brown | 339/256 R |
| 3,717,841 | 2/1973 | Mancini | 339/258 |
| 3,992,076 | 11/1976 | Gluntz | 339/258 |
| 3,997,237 | 12/1976 | White | 339/275 |
| 4,445,747 | 5/1984 | Neidich | 339/256 |
| 4,480,386 | 11/1984 | Adams | 29/874 |
| 4,545,638 | 10/1985 | Neidich | 339/205 |
| 4,560,231 | 12/1985 | Shirai | 339/258 |

FOREIGN PATENT DOCUMENTS 123383 10/1984 European Pat. Off. .

*Primary Examiner*—Joseph H. McGlynn

[57] ABSTRACT

A receptacle is disclosed which includes first and second rectangular frames each having a rectangular opening, so that a plug pin can be detachably inserted into the receptacle through the first rectangular frame. The first rectangular frame is connected to the second rectangular frame through a pair of leaf spring pieces. The pair of leaf spring pieces are inwardly curved toward each other so that the plug pin, when inserted into the receptacle, is electrically connected to the receptacle, and said plug pin is elastically retained between the inwardly curved portions of the leaf spring pieces.

1 Claim, 6 Drawing Figures

RECEPTACLE

BACKGROUND OF THE INVENTION

This invention relates to a receptacle having contacting sections which ensure an elastic, firm contact with an inserted plug pin, and, in particular, to a very small receptacle for use in an IC card and the like.

A miniature receptacle 40 to be fitted on an IC card and the like, is constructed as shown, for example, in FIG. 1. Receptacle 40 comprises cylindrical contact 41, and connection pin 42 extending from one end of contact 41. Receptacle 40 as a whole is formed of a metal sheet which has excellent elasticity. Cylindrical contact 41 has a diameter l which is formed so as to be somewhat smaller than a diameter d of plug pin 50, as shown in FIG. 2. When plug pin 50 is inserted into cylindrical contact 41, contact 41 can firmly hold and maintain contact with plug pin 50.

Such receptacles 40 are individually fitted in corresponding holes 61, which are arranged in a grid-like array in receptacle housing 60. The receptacle housing can be incorporated into, for example, an IC card. The grid-like array is of such a high density type as to permit ten receptacles to be formed within a range of, for example, 1 cm across the end face of the housing. From this it will be understood that the individual receptacles are very small in configuration.

Since contact 41 is formed so as to have a cylindrical configuration, the holding ability of contact 41 is markedly reduced due to the repeated insertion and withdrawal of the plug pin into and from the receptacle. This is due to the fact that the cylindrical contact undergoes an outwardly expanding force due to the exertion of a twisting force of the plug pin upon the cylindrical contact during insertion and withdrawal of the plug pin.

SUMMARY OF THE INVENTION

It is accordingly the object of this invention to provide a very small receptacle which has a much improved receptacle configuration, which undergoes no deformation at a plug pin inlet and associated contact portion even if, for example, the plug pin is tilted in its insertion and withdrawal directions, and which results in less friction upon the mating contact of the plug pin with the receptacle, and which is therefore durable even when subjected to repeated insertion and withdrawal operations.

According to this invention a receptacle is provided which comprises:

first and second rectangular frames each having a rectangular opening, so that a plug pin can be detachably inserted into the first frame through the rectangular opening;

a pair of leaf spring pieces connecting the first frame to the second frame and arranged opposite to each other between respective pairs of opposite sides of the rectangular first and second frames; and an external connection pin formed at one of the two opposite sides of the second frame, such that it extends away from the first frame, in which the pair of leaf spring pieces are inwardly curved toward each other so that they can elastically retain the plug pin when the latter is inserted into the receptacle through the first frame. Since the plug pin is firmly held by the pair of leaf spring pieces with some clearance left between the plug pin and the frame, any unwanted displacement and tilting of the plug pin, which are caused when the plug pin is inserted into the receptacle, are absorbed by the specific configuration of the receptacle. As a result, the receptacle is less liable to be deformed and thus has improved resistance against deformation and twisting.

DETAILED DESCRIPTION OF THE PREFERRED EMBODIMENTS

A receptacle according to the embodiment of this invention will now be explained below with reference to the accompanying drawings.

Figure 1:
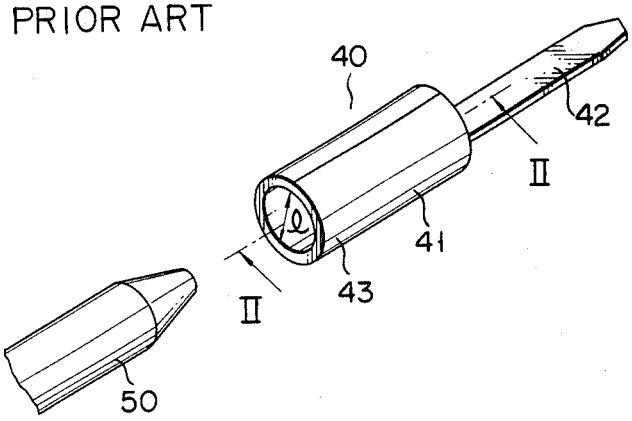
FIG. 1 PRIOR ART
FIG. 1 is a view showing a conventional receptacle to be associated with a plug pin.
Figure 2:
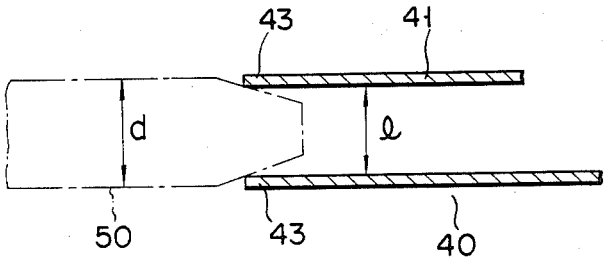
FIG. 2 PRIOR ART
FIG. 2 is a cross-section as taken along line II—II in FIG. 1.
Figure 3:
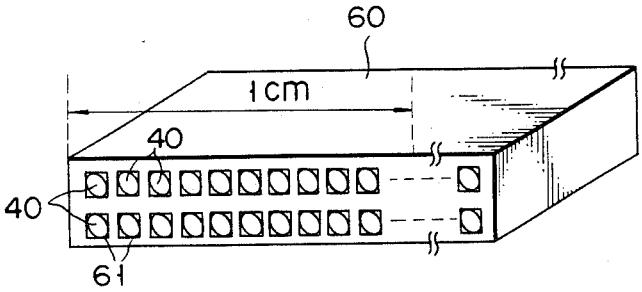
FIG. 3 PRIOR ART
FIG. 3 is an outer appearance of a receptacle housing having a number of receptacles.
Figure 4:
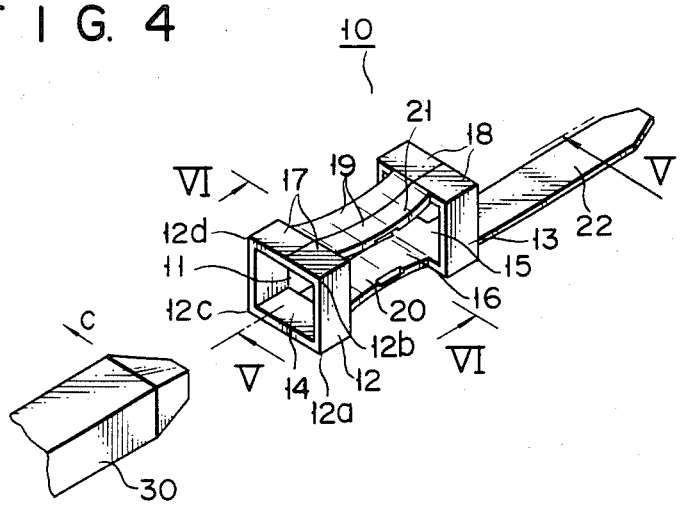
FIG. 4 is a perspective view showing a detail of a receptacle according to an embodiment of this invention.

In FIG. 4, receptacle 10 is basically formed by bending a piece of metal sheet into a rectangular configuration. Receptacle 10 is comprised of first frame 12 having a rectangular opening at plug pin insertion inlet 11, and second frame 13 formed at a location remote from the plug pin insertion inlet such that it is positioned opposite the first frame. Bottom surface 14 of first frame 12 is connected to bottom surface 15 of second frame 13 by first leaf spring piece 16 which is bowed inwardly of receptacle 10. Top surface 17 of first frame 12 is similarly connected to top surface 18 of second frame 13 by second leaf spring piece 19. These leaf spring pieces 16 and 19 can be brought, at their respective middle curved portions 20 and 21, into elastic contact with plug pin 30. External connection pin 22 is formed at bottom surface 15 of second frame 13 so that it extends away from first leaf spring piece 16.

Figure 5:
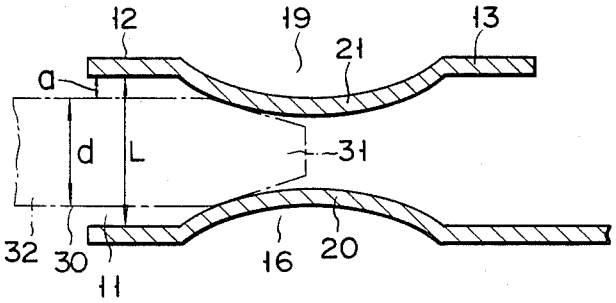
FIG. 5 is a cross-sectional view as taken along line V—V in FIG. 4.

As shown in FIG. 5, inlet 11 of first frame 12 has an inner diameter L greater than a diameter d of body 32 of plug pin 30, thus preventing first frame 12 from being externally expanded by plug pin 30 during the insertion of plug pin 30. Since inlet 11 of the receptacle is made wider as set forth above, even if plug pin 30 is displaced in the direction of an arrow c in FIG. 4 or tilted in the direction of insertion of plug pin 30, such a displacement or tilt can be absorbed to a certain extent, thus preventing unwanted deformation from occurring at first frame 12 and leaf spring pieces 16 and 19.

First frame 12 is formed by bending a portion of piece of metal sheet into a rectangular configuration. For this reason, first frame 12 is mechanically stronger due to the presence of corners 12*a*, 12*b*, 12*c*, and 12*d*, and is less prone to deformation than in a conventional cylindrical receptacle, even if an outwardly expanding external force is exerted on first frame 12.

As shown in FIG. 5, leaf spring pieces 16 and 19 are smoothly curved in an arcuate fashion to allow plug pin 30 to be inserted along their curved surface. That is, the forward end 31 of plug pin 30 is less likely to be worn, as there is a smaller friction contact angle between plug pin 30 and leaf spring pieces 16 and 19. Furthermore, since body 32 of plug pin 30 is in contact with leaf spring pieces 16 and 19, and not in contact with first frame 12, less wear occurs on the plug pin. Since the leaf spring pieces 16 and 19 are supported at both ends, and have no intermediate support member fixed in between, the plug pin is brought into stable, flexible contact with leaf spring pieces 16 and 19.

Figure 6:
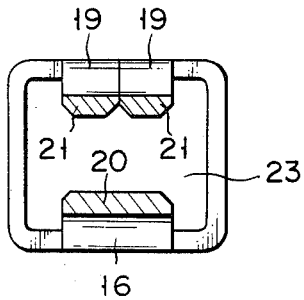
FIG. 6 is a cross-sectional view as taken along line VI—VI in FIG. 4.

In FIG. 6, curved portions 20 and 21 of leaf spring pieces 16 and 19 are chamfered at their longitudinal side edges. Usually there is a risk that a plug pin will be damaged, or be in defective electrical contact with a receptacle, due to flash- or burr-like corners formed at the cut edge of a piece of metal sheet. Since according to this invention the side edges of the curved portions of leaf spring pieces 16 and 19 are chamfered, there is less risk that the plug pin will be damaged or be in defective electrical contact with the receptacle.

What is claimed is:

1. A receptacle comprising:

first and second rectangular frames each having a rectangular opening, so that a plug pin can be detachably inserted into the first frame through the rectangular opening;

a pair of leaf spring pieces connecting the first frame to the second frame and arranged opposite each other between respective pairs of opposite sides of the rectangular first and second frames; and an external connection pin formed at one of the two opposite sides of the second frame such that it extends away from the first frame, in which said pair of leaf spring pieces are inwardly curved toward each other so that they can elastically retain said plug when the latter is inserted into said receptacle through said first frame, the opposite surfaces of said pair of leaf spring pieces being chamfered at their side edges.

* * * * *